US005996916A

United States Patent [19]

Musil

[11] Patent Number: 5,996,916

[45] Date of Patent: Dec. 7, 1999

[54] CONE CRUSHER HAVING POSITIVE HEAD HOLD-DOWN MECHANISM

[75] Inventor: Joseph E. Musil, Ely, Iowa

[73] Assignee: Cedarapids, Inc., Cedar Rapids, Iowa

[21] Appl. No.: 08/997,054

[22] Filed: Oct. 17, 1997

Related U.S. Application Data

[63] Continuation of application No. 08/730,125, Oct. 15, 1996, abandoned.

[51] Int. Cl.[6] ..... B02C 2/04

[52] U.S. Cl. ..... 241/215

[58] Field of Search ..... 241/207–216

[56] References Cited

U.S. PATENT DOCUMENTS

| | | | |
|---|---|---|---|
| 1,000,049 | 8/1911 | Symons . | |
| 2,079,882 | 5/1937 | Traylor | 241/215 |
| 3,887,143 | 6/1975 | Gilbert et al. | 241/215 |
| 3,924,815 | 12/1975 | Haggren . | |
| 4,245,792 | 1/1981 | Ivanov et al. . | |
| 4,410,143 | 10/1983 | Polinski . | |

FOREIGN PATENT DOCUMENTS

| | | | |
|---|---|---|---|
| 1285276 | 12/1968 | Germany | 241/215 |

*Primary Examiner*—Mark Rosenbaum

*Attorney, Agent, or Firm*—Marshall, O'Toole, Gerstein, Murray & Borun

[57] ABSTRACT

A gyratory crusher having a positive head hold-down mechanism. The crusher includes a frame structure; a first mounting arrangement including a pair of taper bearings for rotatably mounting an eccentric member to the frame structure about a vertically oriented first axis; a second mounting arrangement including a spherical bearing for spiderlessly and rotatably mounting a main shaft to the eccentric member about a substantially vertically oriented second axis angularly offset from the first axis; a crusher head mounted on said main shaft; drive means including a bevel gear secured to the eccentric member and a drive pinion arrangement for rotating said eccentric member about the first axis; a hold-down mechanism fixedly mounted to the crusher head for preventing vertical displacement of the crusher head relative to the a plurality of hydrostatic bearings operably supporting the crusher head; and seal means for protecting moving components of the crusher.

47 Claims, 2 Drawing Sheets

CONE CRUSHER HAVING POSITIVE HEAD HOLD-DOWN MECHANISM

This is a Continuation of U.S. application Ser. No. 08/730,125, filed Oct. 15, 1996, now abandoned.

BACKGROUND OF THE INVENTION

1. Field of the Invention

The invention relates generally to a gyratory or cone crusher.

2. Background of the Related Art

Gyratory crushers or cone crushers are characterized by crushing or crusher heads having a generally cone-shaped outer surface, which are mounted to undergo gyratory motion. The cone-shaped crusher head of a gyratory crusher is generally centered about a head axis that is angularly offset from a vertical crusher axis generally centered through the crusher. The outer surface of the head is generally protected by a replaceable mantel.

The crushers are further characterized by a bowl-shaped member, sometimes referred to as a concave or bonnet, disposed in an inverted position generally over the cone-shaped crusher head and centered about the vertical crusher axis. The inner surface of the bowl-shaped member is protected by a replaceable bowl liner. The outer dimensions of the head and mantel are smaller than the corresponding inner dimensions of the bowl liner. The head is mounted such that there is a space between the mantel and the bowl liner, sometimes referred to as the "crushing chamber" or "crushing cavity". The volume of the crushing cavity can be increased by altering the shape of the exposed surface of the bowl liner and/or the shape of the exposed surface of the mantel. It can also be increased or decreased by vertically adjusting the elevation of the mantel relative to the elevation of the bowl liner. The bowl-shaped member has an upper opening through which material to be crushed can be fed into the crushing cavity.

The smallest distance between the mantel and the bowl liner at the bottom of the crushing cavity is called the "closed side setting" or "setting" of the crusher. The width of the setting determines the size of crushed materials operably produced by the crusher. The setting can be enlarged to increase the size of the crushed material produced by the crusher, and can be decreased to reduce the size of the crushed material produced by the crusher. The setting can be adjusted by simply raising or lowering the elevation of the bowl liner relative to the elevation of the crusher head, or by raising or lowering the elevation of the crusher head relative to the elevation of the bowl liner. The difference between the width of the closed side setting and the spacing between the mantel and the bowl liner at the bottom of the crushing cavity directly opposite from the closed side setting, sometimes called the "open" side or "open side setting", is called the "throw" or "stroke" of the crusher.

The small angular offset of the head axis relative to the vertical crusher axis is provided by mounting the head on an eccentric element, or other suitable mounting. The head is caused to gyrate relative to the bowl-shaped member by rotating that mounting or eccentric element. As the eccentric element rotates, one side of the head is caused to approach the bowl liner until it attains the closed side setting while the opposite side of the head recedes from the bowl liner until it simultaneously attains the open side setting. The closed side setting and open side setting operably travel around the periphery of the lower end of the crushing cavity as the eccentric element is rotated, each making a complete revolution around the crusher head for each revolution of the eccentric element. The magnitude of the gyration is determined by the angle that the head axis is offset from the crusher axis and by the location of the point at which those two axes most closely approach or intersect.

State-of-the-art gyratory or cone crushers are generally driven by a horizontally disposed countershaft which radially extends into a lower part of a generally cylindrical crusher housing. An inner end of the countershaft is coupled through a pinion and ring gear to the eccentric element to rotatably drive the eccentric element.

A motor (either electric or combustion) is used to drive the crusher. The speed of the motor, the size ratio of the pulleys on the motor and the crusher, and the gearing of the eccentric element determine the speed at which the head gyrates, sometimes referred to as the "gyrational speed". The gyrational speed selected for each crusher depends on the particular application for which the crusher is to be used. Increasing or decreasing the gyrational speed is usually a matter of changing the speed of the motor, changing the relative sizes of the pulleys on the motor and/or the crusher, and/or changing the gear ratios for the eccentric.

The gyratory or gyrating motion of the cone-shaped crusher head performs a material comminution action on material, such as rock, ore, coal and other hard substances, as the material is fed through the bowl opening into the crushing cavity. The material typically moves by gravity through the annular space or crushing cavity between the exposed surface of the stationary bowl liner and the exposed surface of the cone-shaped mantel. As the gyrating head approaches the liner, it crushes the material; as it recedes from the liner, the material falls farther down the crushing cavity to undergo further crushings during subsequent revolutions of the eccentric member. As the separation between the bowl liner and the head gradually decreases from top to bottom, such progressive crushing action repeatedly occurs until the crushed material is discharged from the bottom of the crushing cavity.

The crushing heads of prior art gyratory crushers generally utilize two different mounting mechanisms—spider-type, wherein head mounting support is provided both above and below the crushing head, and spiderless, wherein head mounting support is provided only from below the crushing head. Obviously, greater demands are placed on a spiderless mounting mechanism due to the moments randomly generated during crushing processes.

Further and due to their massiveness, spiderless crushing heads are generally held in place gravitationally on its underlying mounting mechanism. During high speed operations, however, the crushing head tends to levitate or "de-seat", which occurs as the radial acceleration force exceeds the gravitational component of the crushing head weight that normally maintains the crushing head seated on its mounting mechanism. Obviously, the downwardly directed forces generated during actual crushing operations is more than sufficient to prevent the crushing head from levitating; the problem arises primarily during startup or when the crusher has temporarily emptied between inputs of material to be crushed. Unfortunately, levitation of a crushing head that is supported by bearings radially displaced from the longitudinal axis of the crushing head, particularly during high performance crushing operations, substantially increases wear and maintenance over that observed for such crushers that do not experience levitation.

What is needed is a gyratory crusher that has a mechanism for positively preventing the crushing head from levitating from support bearings radially displaced from a longitudinal axis thereof.

SUMMARY OF THE INVENTION

An improved gyratory crusher having a positive head hold-down mechanism is provided for crushing rock, ore, coal and other hard substances. The gyratory crusher includes a frame structure, including a lower frame portion, an upper frame portion supported by the lower frame portion, and a bonnet supported by the upper frame portion. The bonnet has an upper opening for receiving the material to be crushed.

The gyratory crusher also includes an eccentric member, a main shaft, and a conically shaped crusher head. A first mounting arrangement, including a pair of taper bearings, is provided for mounting the eccentric member to the frame structure such that the eccentric member is rotatable about a vertically oriented crusher axis. A second mounting arrangement, including a spherical bearing, is provided for spiderlessly mounting the main shaft to the eccentric member such that the main shaft is rotatable about a substantially vertically oriented head axis angularly offset from the crusher axis. The crusher head is securely mounted on the main shaft such that the crusher head is rotatable about the head axis and such that a crushing chamber is formed between the crusher head and the bonnet. The gyratory crusher also includes a plurality of hydrostatic bearings configured to operably abuttingly engage and support the crusher head on a lubricant film provided by a lubricating system configured to operatively lubricate the moving components and sliding interfaces of the crusher.

The gyratory crusher also includes a hold-down mechanism for preventing operable vertical displacement and levitation of the crusher head relative to the the eccentric member and the plurality of hydrostatic bearings. The hold-down mechanism includes a plate extending beneath the second mounting arrangement and the main shaft and securing means for securing the plate to the main shaft. The main shaft has an axially situated second throughbore such that an elongate draw rod therethrough threadably and rotationally connects the plate to the main shaft and the crusher head. The second throughbore is configured such that the head of the bolt is accessible through an upper end of the second throughbore.

The gyratory crusher also includes a flexible seal that is configured to operatively protect moving components thereof, including the first and second mounting arrangements and the plurality of hydrostatic bearings, from dust and grit generated during crushing operations. An outer edge of the flexible seal is secured to the crusher head and an inner edge of the flexible seal is secured to an outer race of a ball bearing seal, the inner race of which is secured to non-rotating members of the mounting arrangement.

A driving arrangement, including a bevel gear centered about the crusher axis and secured to the eccentric member, provides power for operating the crusher.

PRINCIPAL OBJECTS AND ADVANTAGES OF THE INVENTION

The principal objects and advantages of the present invention include: providing a gyratory crusher that has a precisely and accurately located eccentric element relative to lower framework of the crusher; providing such a gyratory crusher that has a positive head hold-down mechanism; providing such a gyratory crusher having a hold-down mechanism that prevents operable vertical displacement between a crusher head and an eccentric member thereof; providing such a gyratory crusher having a hold-down mechanism that prevents a crusher head from levitating during use thereof; providing such a gyratory crusher having a hold-down mechanism that operably maintains a crusher head and a plurality of hydrostatic bearings thereof in abutting engagement; and generally providing such a gyratory crusher that is efficient in operation, capable of long operating life, and particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
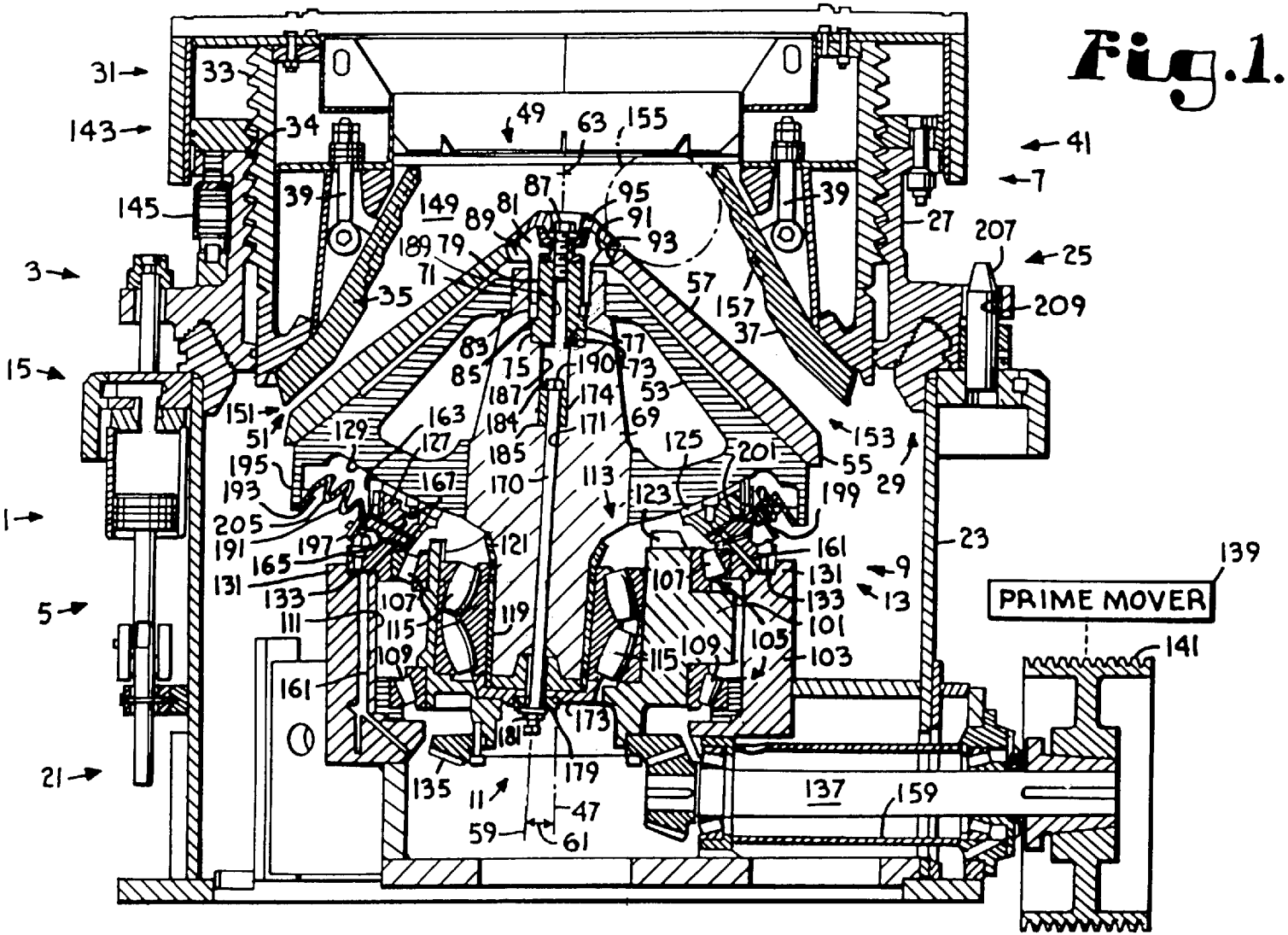
FIG. 1 is a fragmentary, partially cross-sectional, partially schematic, side elevational view of a gyratory crusher having a positive head hold-down mechanism, according to the present invention.
Figure 2:
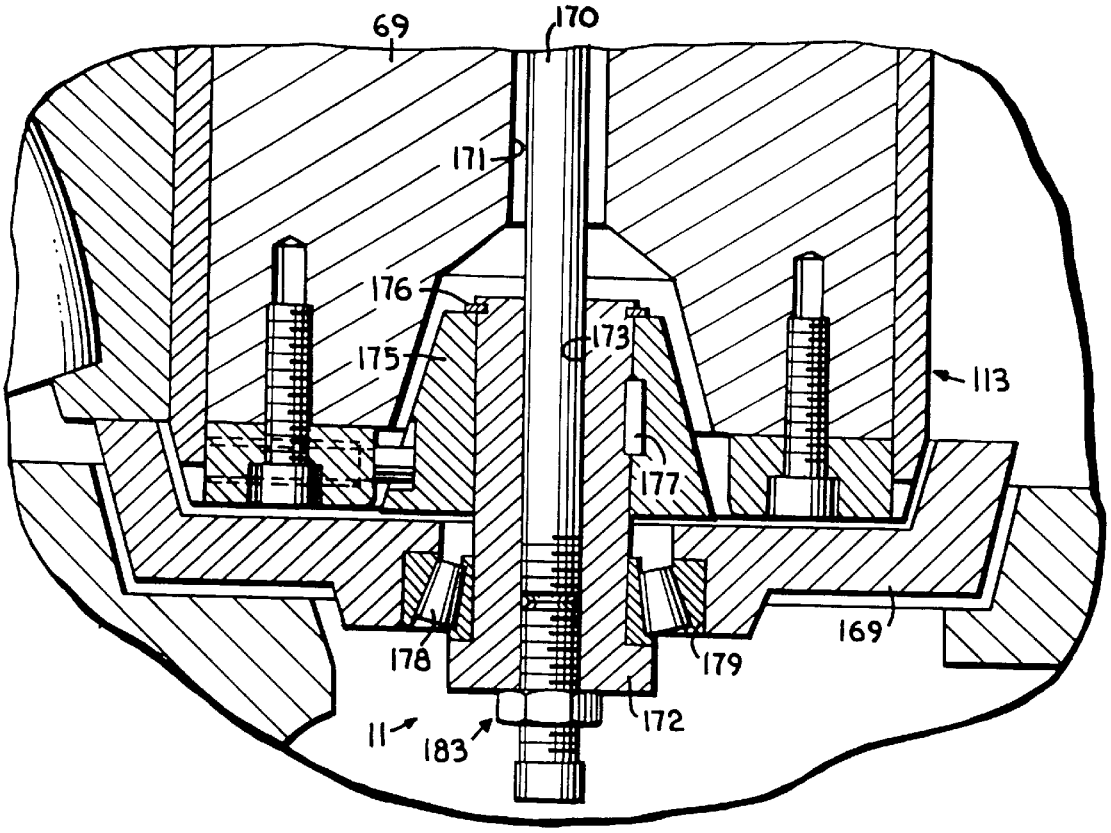
FIG. 2 is an enlarged and fragmentary, partially cross-sectional and side elevational view of the gyratory crusher having a positive head hold-down mechanism.
Figure 3:
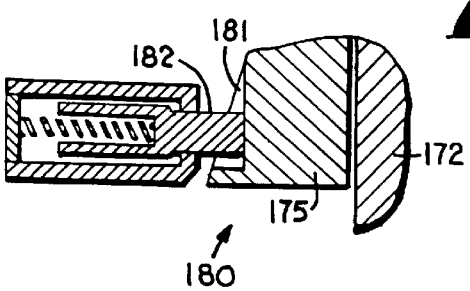
FIG. 3 is a further enlarged and fragmentary, cross-sectional and side elevational view of a capture mechanism of the gyratory crusher having a positive head hold-down mechanism, according to the present invention.

The reference numeral 1 generally refers to a gyratory crusher in accordance with the present invention, as shown somewhat simplified to highlight particular features of the present invention in FIGS. 1 through 3. The crusher 1 includes frame structure 3, head mounting means 5, adjusting means 7, lubricating means 9, head hold-down means 11, dust seal means 13, and a tramp iron relief system 15.

The frame structure 3 includes a lower frame portion 21 having a wall 23 and an upper frame portion 25 having a wall 27. A "V-seat" arrangement 29 is peripherally situated between the lower frame portion 21 and the upper frame portion 25, similar to that disclosed in U.S. Pat. No. 4,773,604 entitled "Seat Member for Gyratory Rock Crusher Bowls" and issued Sep. 27, 1988. A bowl, concave or bonnet 31 is mounted on the upper frame portion 25 by threads 33 thereof mating with threads 34 of the upper frame portion 25. A bowl liner 35 having an exposed surface 37 is replaceably mounted on the bonnet 31 by liner connectors 39 by methods known by those with skill in the art.

The bowl liner 35 is a wear item that is replaceable while the crusher 1 is shut down during a maintenance procedure. The upper frame portion 25, the bonnet 31 and the bowl liner 35, which may sometimes be collectively referred to herein as an upper assembly 41, are all generally centered about a vertically oriented crusher axis 47, located generally centrally of the crusher 1. The bowl liner 35 has the general profile of a hollow truncated cone with a generally circularly shaped upper opening 49 and a wider, generally circularly shaped lower opening 51. The upper opening 49 provides a material feed or intake opening for the crusher 1.

Extending upwardly through the lower opening 51 and into the space encompassed by the bowl liner 35 is a crusher head or cone head 53 of the crusher 1. The crusher head 53 is generally conically shaped. A mantel 55, replaceably mounted on the crusher head 53 as hereinafter described, provides a conical upwardly facing crushing surface 57 for the crusher head 53. The crusher head 53 is centered about a generally vertically oriented head axis 59, which is disposed and supported at an angle of deviation or angular offset with respect to the crusher axis 47, as indicated by the numeral 61. The head axis 59 and the crusher axis 47 intersect at an apex of gyration or apex 63 that generally lies centrally above the crusher head 53. During operation of the crusher 1, the crusher head 53 gyrates about the apex 63 with respect to the bonnet 31.

The head mounting means 5 includes a main shaft 69, centered about the head axis 59, for receiving the crusher head 53 thereon. An upper end 71 of the main shaft 69 has a tapped partial bore 73 for threadably receiving a mantel stud 75. It should be noted that the main shaft 69 and the crusher head 53 are spiderlessly mounted in the crusher 1.

The mantel stud 75 has an inner threaded portion 77 for mating with the tapped partial bore 73 and an outer threaded portion 79 for mating with a mantel nut 81 as hereinafter described. The handedness of the inner threaded portion 77 and the outer threaded portion 79 is such that the mantel stud 75 and the mantel nut 81 are self-tightening. The threads of the inner threaded portion 77 and the outer threaded portion 79 have an appropriate pitch, such as four threads per inch for the outer threaded portion 79 and six threads per inch for the inner threaded portion 77, for example.

At least one, preferably two or more, partial bores 83, aligned parallel with the head axis 59, are located across the mated threads of the partial bore 73 and the inner threaded portion 77 for receiving a respective dowel pin 85 therein. The dowel pins 85 are adapted to prevent over-tightening of the mantel stud 75 during the crushing operations and to thereby facilitate subsequent removal or replacement of the mantel stud 75, thereby allowing low-cost replacement of a corresponding thread system that holds a mantel bolt 87 without having to remove or replace the main shaft 69, or to gain access to the head hold-down means 11 as hereinafter described.

The mantel 55 is attached to the crusher head 53 by placing the mantel 55 on the crusher head 53 and positioning a mantel washer or "torch ring" 89 over the outer threaded portion 79. The mantel nut 81, which is configured to be threadably advanceable along the outer threaded portion 79, has outwardly tapered shoulders 91 which, in conjunction with the mantel washer 89 and an appropriately sized and shaped mantel orifice 93 through the mantel 55, centers and secures the mantel 55 to the crusher head 53. A mantel cap 95 is secured to the mantel nut 81 by the bolt 87 to protect the mantel nut 81 and the mantel washer 89 from material falling through the upper opening 49.

The head mounting means 5 also includes an eccentric member 101 mounted within an encasement portion 103 of the lower frame portion 21. Rotational movement of the eccentric member 101 relative to the encasement portion 103 is provided by a first or eccentric mounting arrangement 105, such as a pair of opposing taper bearings 107, 109 centered about the crusher axis 47.

The eccentric member 101, in combination with a cavity 111 centered about the crusher axis 47 within the encasement portion 103, is configured to provide the angular offset 61. Rotational movement of the crusher head 53 relative to the eccentric member 101 is provided by a second or shaft mounting arrangement 113, such as a spherical bearing 115 with an inside race centered about the head axis 59. A bushing 119 and a spacer 121 about the main shaft 69 appropriately locate the spacing of the main shaft 69 relative to the inner race of the spherical bearing 115. Counterweight 123 can be attached to the eccentric member 101 to balance the gyratory forces, as shown in FIG. 1, and/or to the outer race of the spherical bearing 115, as needed.

To provide adequate mounting for the taper bearings 107, 109 while also providing added support for the substantial stress forces generated during the crushing operating, the crusher head 53 is mounted in abutting engagement with a plurality of hydrostatic bearings 125, mounted on thrust seats 127 spaced generally equidistantly around the crusher axis 47. A bottom surface 129 of the crusher head 53 is spherically shaped, with the center of curvature thereof located at the apex 63, such that the abutting engagement between the hydrostatic bearings 125 and the surface 129 form a sliding interface as the crusher head 53 gyrates and rotates during the crushing operation.

The thrust seats 127 are mounted on and jointly supported by an upper end 131 of the encasement portion 103. Selected ones of a plurality of shims 133 having different thicknesses provide the desired loading of the taper bearings 107, 109. In so doing, the eccentric member 101 is precisely located, both axially and radially, relative to the encasement portion 103.

By precisely mounting and locating the eccentric member 101 relative to the encasement portion 103 with the taper bearings 107, 109, a gear 135, such as a bevel gear, can be centered about the crusher axis 47 and attached directly to the eccentric member 101, thereby eliminating the more complicated, more expensive and higher maintenance gear arrangements of prior art crushers. A drive train or drive pinion arrangement 137, meshed with the gear 135 and connected to a prime mover 139 through a sheave 141, or other suitable means, provides means for powering the crusher 1.

The crushing operation is effected by the spacing between the crusher head 53 and the bonnet 31 or, more particularly, the spacing between the mantel 55 and the bowl liner 35. A releasable clamping arrangement 143 jams the opposing threads 33, 34 against each other to prevent relative rotation of the threads 33, 34 except when desired. Preferably, the clamping arrangement 143 is activated by hydraulically operated, appropriately spaced cylinders 145.

Wear occurring on the respectively exposed mantel surface 57 and the bowl liner surface 37 tends to increase the spacing therebetween. Consequently, the adjusting means 7, which provides the ability to make periodic corrective adjustments of the spacing between the mantel 55 and the bowl liner 35, includes the threads 33, 34 which permit continuous adjustment of the axial position of the bonnet 31 in a stepless up or down displacement by rotating the bonnet 31 clockwise or counterclockwise, as appropriate, about the crusher axis 47 with respect to the upper frame portion 25. Additionally, the adjusting means 7 may be utilized to adjust the size of crushed product produced by the crusher 1.

To adjust the separation between the mantel 55 and the bowl liner 35, the hydraulic cylinders 145 are bled whereby the jamming pressure between the opposing threads 33, 34 is reduced allowing the mating surfaces of the threads 33, 34 to be displaced relative to each other. If it is desired to increase the separation between the bowl liner 35 and the mantel 55, the threads 33 of the bonnet 31 are rotated relative to the mating threads 34 of the upper frame portion 25 such that the bonnet 31 is threadably advanced upwardly. Conversely, if it is desired to decrease the separation between the bowl liner 35 and the mantel 55, the threads 33 of the bonnet 31 are rotated in the opposite direction relative to the mating threads 34 of the upper frame portion 25 such that the bonnet 31 is threadably advanced downwardly. After attaining the desired separation between the bowl liner 35 and the mantel 55, forces exerted by the clamping arrangement 143 are reasserted to maintain the newly established separation between the bowl liner 35 and the mantel 55.

Included conical angles of the bowl liner 35 and the mantel 55 are configured to provide an annular space or crushing chamber 149 between the bowl liner surface 37 and the mantel surface 57, the width thereof generally decreasing downwardly. An annular gap 151 at the lower opening 51 between the bowl liner 35 and the mantel 55 constitutes an annular material discharge opening 153 from the crushing chamber 149. During operation of the crusher 1, material is fed into the crushing chamber 149 through the upper opening 49, which material is gravitationally urged downwardly through the annular crushing chamber 149 and is reduced in size through repeated crushing contacts between the adjacent surfaces 37 and 57 of the bowl liner 35 and the mantel 55.

The maximum size of material that can be crushed by the crusher 1 is determined by the spacing between the uppermost ends of the bowl liner surface 37 and the mantel surface 57, as indicated by the phantom circle designated by the numeral 155. If desired, a plurality of flutes 157 may be formed in the bowl liner surface 37 whereby occasional oversized material may be received by the crushing chamber 149 to thereby increase the maximum opening of the crushing chamber 149 without increasing the size of the crusher 1.

The lubricating means 9 of the crusher 1 is generally self-contained and includes an arrangement for circulating lubricant through the crusher 1 to lubricate the various moving parts thereof. More specifically, lubricant is pressure pumped from within a casing 159, and/or an oil pan (not shown) associated therewith, and distributed to each of the hydrostatic thrust bearings 125, the eccentric mounting arrangement 105, the shaft mounting arrangement 113, the drive pinion arrangement 137, etc.

The pressurized lubricant is conveyed to the interface between the hydrostatic bearings 125 and the bottom surface 129 of the crusher head 53 by oil channels 161. The lubricant is sufficiently pressurized whereby a thin film of lubricant is continuously forced between each of the hydrostatic bearings 125 and the bottom surface 129 of the crusher head 53. Typically, the thin film of lubricant has a thickness in the range of approximately 0.005–0.015 inches.

Lubricant sprays outwardly from the interface between the hydrostatic bearings 125 and the bottom surface 129 and, as it cascades downwardly, lubricates the other moving parts of the head mounting means 5 therebelow. Spring loaded wiper rings 163 cause lubricant sprayed radially outwardly from the hydrostatic bearings 125 to be directed downwardly onto a seal bearing 165. Lubricant is gravitationally returned to the casing 159 and/or (unshown) oil pan from the seal bearing 165 and other pockets by weep holes 167.

The head hold-down means 11 is configured to operably prevent vertical displacement of the crusher head 53 relative to the eccentric member 101 and the drive pinion arrangement 137 and thereby positively hold down the crusher head 53 and prevent levitation of the crusher head 53 from its abutting engagement with the plurality of hydrostatic bearings 125 during startup, while running empty and awaiting inputting of additional material to be crushed, etc. In other words, the head hold down means 11 is configured to apply a downwardly directed force to the crusher head 53 to supplement the gravitational forces thereof. For example, such a supplement force of approximately seven thousand pounds may be sufficient for a fifty-four inch cone crusher. Of course, the magnitude of such a supplemental force is dependent on the size of the crusher and the gyrational speed of the crusher. As the size and/or the speed increases or decreases, the required supplemental forces accordingly increases or decreases.

The hold-down means 11 includes a plate or retaining cup 169 extending beneath the shaft mounting arrangement 113 and the main shaft 69 and securing means for securing the retaining cup 169 to the main shaft 69, such as an elongate bolt or draw rod 170 slidably extending through a throughbore 171, axially situated in the main shaft 69. A tapped sleeve 172 has a tapped throughbore 173 configured to threadably receive the draw rod 170 whereby the draw rod 170 may be "loaded" by being tightened against Belleville-type washers 174, as shown in FIG. 1, or loading by other suitable means. The specialized washers 174 permits spacing between the hydrostatic bearings 125 and the crusher head 53 to slightly relax the minute amount needed by the lubricant film therebetween.

The sleeve 172 is mounted within a conically shaped fitting 175 configured to prevent axially downward displacement of the sleeve 172 relative to the fitting 175, such as by a snap ring 176, and rotational movement of the sleeve 172 relative to the fitting 175, such as by a key 177. In addition, the sleeve 172 is mounted by a thrust bearing 178 in a centrally situated orifice 179 in the retaining cup 169. As a result, forces generated by the crusher head 53 which might otherwise cause the crusher head 53 to levitate from the hydrostatic bearings 125 are transmitted through the inner race of the spherical bearing 115 to the outer race thereof, preventing such levitation. The thrust bearing 178 is also configured to permit rotation of the main shaft 69 relative to the inner race of the spherical bearing 115 that might otherwise cause the draw rod 170 to threadably detach from the sleeve 172.

A capture mechanism 180, such as one or more detents 181, each configured to receive a respective spring loaded thruster 182, is shown in FIG. 3 for example, to prevent the draw rod 170 from rotating relative to the main shaft 69. A stop mechanism 183, threadably received in the throughbore 173 and tightened against the sleeve 172 as shown in FIG. 2, provides a reference for readily repositioning the draw rod 170 relative to the sleeve 172 in order to repeat and reapply a selected, previously utilized hold-down force of the hold-down mechanism 11 without measuring to reestablish previous positioning of the draw rod 170 relative to the sleeve 172.

In other words, a rod head 184 of the draw rod 170 bears downwardly on a shoulder 185 via the Belleville-type washers 174, preventing the main shaft 69 from being displaced upwardly relatively to the retaining cup 169 and the spherical bearing 115. As the spherical bearing 115 is axially fixedly secured, but not rotationally fixedly secured, to the eccentric member 101 such as by the counterweight 123 as shown in FIG. 1, by "shrink-fitting", or by other suitable means, and as the eccentric member 101, and, therefore, the hydrostatic bearings 125 through the taper bearings 107, 109, is axially fixedly secured to the encasement portion 103, the crusher head 53 and main shaft 69 are prevented from being operably displaced axially relative to the hydrostatic bearings 125. It should be obvious that the draw rod 170 rotates and gyrates with the main shaft 69 and the crusher head 53.

Bores 187 and 189 provide access to the rod head 184 for removal, inspection, or tightening purposes by removal of the mantel bolt 87, such as by a formed depression 190 in the rod head 184 configured to matingly receive an Allen wrench received through the throughbore 189. If necessary, the mantel cap 95 and the mantel stud 75 may be removed to provide better access to the rod head 184.

The dust seal means 13 is adapted to isolate inner moving components, such as the interface between the hydrostatic bearings 125 and the bearings 107, 109 and 115, from abrasive contamination arising from the ubiquitous dust and grit generated during the crushing process. The dust seal means 13 includes a flexible seal 191 having an outer edge 193 secured to a lower extremity 195 of the crusher head 53 and an inner edge 197 secured to an outer race 199 of the seal bearing 165, an inner race 201 of which is secured to the thrust seats 127. Bearing balls are captured between the inner race 201 and the outer race 199 in peripheral grooves thereof.

To provide the flexibility needed to compensate for the oscillatory displacement of the crusher head 53 due to the gyratory motion thereof, the flexible seal 191 generally has a single-wall construction with a corrugation-like cross-sectional configuration. As the separation between the mantel 55 and the bowl liner 35 at a particular point along the gap 151 approaches the closed side setting, the corrugations or ribs 205 widen to compensate for the corresponding increasing separation between the lower extremity 195 and the outer race 199. Similarly, as the separation between the mantel 55 and the bowl liner 35 approaches the open side setting, the ribs 205 become narrower to compensate for the corresponding decreasing separation between the lower extremity 195 and the outer race 199. To compensate for rotation of the crusher head 53 relative to the bowl liner 35 during a crushing operation, the outer race 199 rotates with the crusher head 53, peripherally relative to the inner race 201.

It is to be understood that the dust seal means 13 may comprise other arrangements provided that the moving parts of the crusher 1 are isolated from the abrasive byproducts common to crushing operations.

The tramp iron relief system 15 includes means for hydraulically providing substantial hold-down forces between the upper frame portion 25 and the lower frame portion 21 and for simultaneously providing the ability to allow the bowl liner 35 to automatically elevate relative to the mantel 55 whereby non-crushable material can be rapidly and automatically ejected from the crusher 1, such as a tramp iron relief system as taught in U.S. Pat. No. 5,718,390, entitled "GYRATORY CRUSHER", which is incorporated herein by reference.

In an application of the present invention, hydraulic fluid is injected into the system to pressurize the hydraulics of the tramp iron relief system 15 as appropriate to clamp the upper frame portion 25 to the lower frame portion 21, particularly across the V-seat arrangement 29.

The closed side setting is adjusted by displacing the bowl liner 35 upwardly or downwardly as needed. Lubricant is pumped to the hydrostatic thrust bearings 125, the eccentric mounting arrangement 105, the shaft mounting arrangement 113, and the drive pinion arrangement 137. The prime mover 139 is drivingly engaged with the sheave 141 to initiate gyration of the crusher head 53 relative to the bowl liner 35.

Rock, ores or other materials are dropped through the upper opening 49 of the bowl liner 35 and are crushed between the mantel 55 and the bowl liner 35 as the material being crushed is gravitationally urged through the crushing chamber 149 to be discharged through the gap 151 thereof.

As non-crushable material that is too large to be processed through the crushing chamber 149, sometimes referred to as "tramp iron", is dropped into the crushing chamber 149, a portion of the bowl liner 35 and the associated portion of the upper frame portion 25 are forced upwardly from the crusher head 53, causing the corresponding portion of the V-seat arrangement 29 to separate, allowing the tramp iron to pass through the crushing chamber 149, whereupon the upper frame portion 25 immediately, hydraulically returned to its normal position relative to the lower frame portion 21.

As the V-seat arrangement 29 is disturbed, such as during passage of tramp iron or "bowl float", stop pins 207 prevent rotation of the upper frame portion 25 relative to the lower frame portion 21. Sleeves or inserts 209, as well as the stop pins 207, are readily replaceable to facilitate replacement of worn parts.

It is to be understood that while certain forms of the present invention have been illustrated and described herein, it is not to be limited to the specific forms or arrangement of parts described and shown.

What is claimed and desired to be secured by Letters Patent is as follows:

1. A gyratory crusher for crushing material, comprising:

(a) a frame structure;

(b) an eccentric member having a first mounting arrangement configured to rotatably mount said eccentric member to said frame structure about a vertically oriented first axis;

(c) a main shaft having a second mounting arrangement configured to spiderlessly and rotatably mount said main shaft to said eccentric member about a substantially vertically oriented second axis angularly offset from said first axis;

(d) a crusher head mounted to said main shaft about said second axis;

(e) drive means for rotating said eccentric member about said first axis; and (f) hold-down means for operably preventing vertical displacement of said crusher head relative to said eccentric member.

2. The gyratory crusher according to claim 1, wherein said first mounting arrangement includes a pair of taper bearings.

3. The gyratory crusher according to claim 1, wherein said second mounting arrangement includes a spherical bearing.

4. The gyratory crusher according to claim 1, wherein said drive means includes a bevel gear centered about said first axis and secured to said eccentric member and a drive pinion arrangement enmeshed with said bevel gear.

5. The gyratory crusher according to claim 1, including:

(a) said frame structure having a lower portion; and (b) a plurality of hydrostatic bearings mounted on said lower portion and configured to operably abuttingly engage said crusher head.

6. The gyratory crusher according to claim 5, wherein said hold-down means is also configured to prevent said crusher head from operably levitating from said abutting engagement with said plurality of hydrostatic bearings.

7. The gyratory crusher according to claim 5, wherein said plurality of hydrostatic bearings are mounted such that said eccentric member is prevented from vertical displacement relative to said lower portion.

8. The gyratory crusher according to claim 5, including seal means for operably protecting said first and second mounting arrangements and said plurality of hydrostatic bearings.

9. The gyratory crusher according to claim 8, wherein said seal means includes:

(a) a seal bearing having
  (1) an inner race connected to said lower portion,
  (2) an outer race, and
  (3) bearing balls captured between said inner and outer races; and (b) a flexible member connected between said crusher head and said outer race.

10. The gyratory crusher according to claim 1, wherein said hold-down means includes:

(a) a retaining cup extending beneath said second mounting arrangement and said main shaft; and (b) securing means for securing said retaining cup to said main shaft.

11. The gyratory crusher according to claim 10, wherein said securing means is rotationally fixed relative to said crusher head.

12. The gyratory crusher according to claim 10, wherein said securing means includes:

(a) said retaining cup having a centrally situated orifice;

(b) said main shaft having an axially situated throughbore;

(c) a draw rod having a threaded distal end; and (d) a tapped sleeve mounted in said orifice and configured to threadably receive said threaded distal end as said draw rod extends through said axially situated throughbore of said main shaft.

13. The gyratory crusher according to claim 12, wherein said draw rod has a rod head that is accessible through an upper end of said throughbore.

14. The gyratory crusher according to claim 13, wherein said securing means also includes:

(a) said throughbore having a shoulder; and (b) Belleville-type washers mounted between said rod head and said shoulder.

15. The gyratory crusher according to claim 13, including a depression in said rod head configured to matingly receive an Allen wrench.

16. The gyratory crusher according to claim 12, including:

(a) a fitting mounted to said sleeve such that axial and rotational displacement of said sleeve relative to said fitting is prevented.

17. The gyratory crusher according to claim 12, including a thrust bearing configured to rotationally mount said tapped sleeve to said retaining cup about said second axis.

18. The gyratory crusher according to claim 12, including a capture mechanism configured to operably prevent rotational displacement of said draw rod relative to said main shaft.

19. The gyratory crusher according to claim 12, including a stop mechanism configured to provide a reference for repositioning of said draw rod relative to said tapped sleeve.

20. A gyratory crusher for crushing material, comprising:

(a) a lower frame;

(b) an upper frame supported by the lower frame and having a bonnet secured thereto, the bonnet having an upper opening for receiving the material;

(c) an eccentric member rotatably mounted to the lower frame;

(d) a crusher head having a main shaft rotatably mounted to the eccentric member, the crusher head and the bonnet forming a crushing chamber therebetween, the main shaft having an upper end and a lower end;

(e) a drive motor for rotating the eccentric member; and (f) a hold down assembly coupled to the lower end of the main shaft arid engaging the eccentric member, the hold down assembly being adapted to limit axial movement of the main shaft relative to the eccentric member.

21. The crusher of claim 20, wherein the crusher head main shaft includes a bore extending axially therethrough, the hold down assembly including a retaining member and a draw rod, the retaining member operatively engaging the eccentric member, the draw rod being disposed through the bore and engaging the retaining member.

22. The crusher of claim 21, wherein the draw rod includes an upper end having a bolt head secured adjacent the main shaft upper end by a resilient washer.

23. The crusher of claim 21, wherein the bore includes a lower end having a counterbore, and wherein a portion of the hold down assembly is received within the counterbore.

24. The crusher of claim 23, wherein the counterbore and the hold down assembly portion are conically shaped.

25. The crusher of claim 20, wherein the hold down assembly includes a retaining cup and a sleeve engaging the retaining cup, the retaining cup engaging the eccentric member, the sleeve being rotatable relative to the retaining cup.

26. The crusher of claim 24, wherein the sleeve is mounted to the retaining cup by thrust bearings.

27. The crusher of claim 25, wherein the sleeve includes a detent, and wherein the main shaft includes a bore extending axially therethrough and a draw rod disposed through the bore and engaging the shaft and the retaining cup, and further wherein the main shaft lower end includes a retractable member positioned to engage the detent to thereby prevent rotation of the draw rod and the sleeve relative to the main shaft.

28. The crusher of claim 27, wherein the retractable member is spring loaded and retracts along a path generally perpendicular to the axis of the main shaft.

29. The crusher of claim 27, wherein the retractable member is removably secured to the main shaft lower end by bolts.

30. The crusher of claim 25, wherein the main shaft includes a bore extending axially therethrough and a draw rod disposed through the bore and engaging the shaft and the retaining cup, a portion of the draw rod being threaded, and further wherein the sleeve includes a threaded bore sized to receive the draw rod threaded portion, and further including a lock nut engaging the draw rod threaded portion for preventing rotation of the sleeve relative to the draw rod.

31. The crusher of claim 30, wherein the draw rod includes adjustment indicia imprinted thereon.

32. The crusher of claim 20, wherein the hold down member includes a tapped sleeve, and the draw rod includes a threaded lower end engaging the tapped sleeve, and a lock nut for locking the relative rotational position of the draw rod and to the tapped sleeve.

33. A gyratory crusher for crushing material, comprising:

(a) a frame;

(b) a bonnet;

(c) a gyrating crusher head having a main shaft supported by the frame for relative gyrational movement, the crusher head and the bonnet forming a crushing chamber therebetween, the main shaft having an upper end and a lower end;

(d) a drive motor for gyrating the crusher head; and (e) a hold down mechanism operatively connecting the lower end of the main shaft to the frame to prevent axial movement of the main shaft relative to the frame.

34. The crusher of claim 33, wherein the main shaft includes a bore extending axially therethrough, the hold down mechanism including a draw rod disposed through the bore and further including a retaining cup operatively engaging the frame, a portion of the draw rod engaging the retaining cup.

35. The crusher of claim 34, wherein the bore includes a lower end having a counterbore, and wherein the hold down mechanism includes a sleeve received within the counterbore.

36. The crusher of claim 35, wherein the sleeve includes a detent, and the main shaft lower end includes a retractable member positioned to engage the detent to thereby prevent rotation of the draw rod and the sleeve relative to the main shaft.

37. The crusher of claim 37, wherein the retractable member is spring loaded and retracts along a path generally perpendicular to the axis of the main shaft.

38. The crusher of claim 37, wherein the retractable member is removably secured to the main shaft lower end by bolts.

39. The crusher of claim 35, wherein the counterbore and the sleeve are conically shaped.

40. The crusher of claim 34, including a sleeve member rotatably mounted to the retaining cup and engaging the draw rod.

41. The crusher of claim 40, wherein the sleeve member is mounted to the retaining cup by thrust bearings.

42. The crusher of claim 34, wherein the hold down mechanism includes a tapped sleeve and the draw rod lower end includes a threaded portion engaging the tapped sleeve, the tapped sleeve being rotationally mounted to the retaining cup by thrust bearings.

43. The crusher of claim 34, wherein the draw rod includes an upper end, the draw rod upper end being secured to the main shaft by a resilient member.

44. The crusher of claim 33, wherein the main shaft is mounted to an eccentric member, the eccentric member being rotatably mounted to the frame.

45. The crusher of claim 33, wherein the hold down mechanism resiliently engages an upper portion of the main shaft.

46. A device for preventing levitation of a crusher head on a gyratory crusher, the gyratory crusher having a frame, a bonnet, and a main shaft supporting the crusher head, a lower end of the main shaft being received in an eccentric member, the device comprising:

a bore extending axially through the main shaft and having a lower end;

a draw rod secured to the crusher head and having a lower end extending to the main shaft lower end;

a sleeve engaging the draw rod lower end; and a retaining member engaging the sleeve and being operatively connected to the eccentric member;

whereby the draw rod, the sleeve, and the retaining member cooperate to prevent undesired vertical movement of the main shaft relative to the frame.

47. A gyratory crusher comprising a frame, a bonnet, a gyrating crusher head supported on a main shaft, and a hold down assembly engaging the main shaft from a lower end thereof to prevent undesired vertical movement of the crusher head relative to the frame and further to permit rotational movement of the crusher head relative to the frame.

* * * * *

UNITED STATES PATENT AND TRADEMARK OFFICE

CERTIFICATE OF CORRECTION

PATENT NO. : 5,996,916
DATED : December 7, 1999
INVENTOR(S) : Musil

It is certified that error appears in the above-identified patent and that said Letters Patent is hereby corrected as shown below:

Column 12,
Line 9, delete “arid”, insert -- and --.
Line 31, delete “24”, insert -- 25 --.
Line 58, delete “the”, insert -- a --.
Line 58, delete “member”, insert -- assembly --.
Line 61, delete “to.”

Column 13,
Line 23, delete “37”, insert -- 36 --.
Line 26, delete “37”, insert -- 36 --.

Signed and Sealed this

Fourth Day of January, 2005

JON W. DUDAS
*Director of the United States Patent and Trademark Office*